US011283154B2

(12) United States Patent
Wen et al.

(10) Patent No.: US 11,283,154 B2
(45) Date of Patent: Mar. 22, 2022

(54) COMMUNICATIONS TERMINAL

(71) Applicant: Huawei Device Co., Ltd., Guangdong (CN)

(72) Inventors: Dingliang Wen, London (GB); Yang Hao, London (GB); Hanyang Wang, Reading (GB); Hai Zhou, Reading (GB); Shuhui Sun, Shenzhen (CN)

(73) Assignee: Huawei Device Co., Ltd., Dongguan (CN)

( * ) Notice: Subject to any disclaimer, the term of this patent is extended or adjusted under 35 U.S.C. 154(b) by 523 days.

(21) Appl. No.: 16/304,970

(22) PCT Filed: May 28, 2016

(86) PCT No.: PCT/CN2016/083776
§ 371 (c)(1),
(2) Date: Nov. 27, 2018

(87) PCT Pub. No.: WO2017/205998
PCT Pub. Date: Dec. 7, 2017

(65) Prior Publication Data

US 2019/0319339 A1 Oct. 17, 2019

(51) Int. Cl.
*H01Q 1/24* (2006.01)
*G04G 21/04* (2013.01)
(Continued)

(52) U.S. Cl.
CPC ..... *H01Q 1/243* (2013.01); *G04G 21/04* (2013.01); *G04R 60/06* (2013.01); *H01Q 1/273* (2013.01); *H01Q 1/36* (2013.01); *H01Q 13/103* (2013.01)

(58) Field of Classification Search
None
See application file for complete search history.

(56) References Cited

U.S. PATENT DOCUMENTS 8,847,832 B2 * 9/2014 Parsche ..... H01Q 7/00 343/743
10,304,271 B2 * 5/2019 Padgett ..... H04W 4/80
(Continued)

FOREIGN PATENT DOCUMENTS

CN 101957590 A 1/2011
CN 202474229 U 10/2012
(Continued)

OTHER PUBLICATIONS

Machine Translation and Abstract of Chinese Publication No. CN105186135, Dec. 23, 2015, 11 pages.
(Continued)

*Primary Examiner* — Trinh V Dinh
(74) *Attorney, Agent, or Firm* — Conley Rose, P.C.

(57) ABSTRACT

A communications terminal includes an antenna Which includes a circuit hoard, a radiator, two feeds, and two coupling structures. The radiator is disposed around an outer edge of the circuit board, and a ring-shape slot is formed between the outer edge of the circuit board and the radiator. A first feed is electrically coupled to a first coupling structure, the first coupling structure is coupled to the radiator along one direction, and a current in a first polarization direction is formed on the circuit board by using the radiator and the ring-shape slot. A second feed is electrically coupled to a second coupling structure, the second coupling structure is coupled to the radiator along another direction, and a current in a second polarization direction is formed on the circuit board by using the radiator and the ring-shape slot. A specific included angle is formed between the above two directions.

20 Claims, 10 Drawing Sheets

(51) Int. Cl.

| | |
|---|---|
| ***G04R 60/06*** | (2013.01) |
| ***H01Q 1/27*** | (2006.01) |
| ***H01Q 1/36*** | (2006.01) |
| ***H01Q 13/10*** | (2006.01) |

(56) References Cited

U.S. PATENT DOCUMENTS

| | | | | |
|---|---|---|---|---|
| 10,886,614 | B2 * | 1/2021 | Lee | H01Q 13/10 |
| 2008/0100530 | A1 | 5/2008 | Manholm et al. | |
| 2011/0013491 | A1 | 1/2011 | Fujisawa | |
| 2012/0157175 | A1 * | 6/2012 | Golko | H01Q 1/241 455/575.7 |
| 2015/0084831 | A1 | 3/2015 | Liu et al. | |
| 2015/0147984 | A1 * | 5/2015 | Ying | H01Q 5/35 455/90.3 |
| 2016/0233574 | A1 * | 8/2016 | Xiong | H01Q 21/28 |
| 2019/0181555 | A1 * | 6/2019 | Lee | H01Q 5/35 |

FOREIGN PATENT DOCUMENTS

| | | | |
|---|---|---|---|
| CN | 103682612 | A | 3/2014 |
| CN | 103943945 | A | 7/2014 |
| CN | 103972648 | A | 8/2014 |
| CN | 104037500 | A | 9/2014 |
| CN | 204614949 | U | 9/2015 |
| CN | 105186135 | A | 12/2015 |
| CN | 105305073 | A | 2/2016 |
| JP | 2003110347 | A | 4/2003 |

OTHER PUBLICATIONS

Foreign Communication From A Counterpart Application, European Application No. 16903386.7, Extended European Search Report dated Apr. 9, 2019, 10 pages.

Machine Translation and Abstract of Chinese Publication No. CN103943945, Jul. 23, 2014, 14 pages.

Machine Translation and Abstract of Chinese Publication No. CN105305073, Feb. 3, 2016, 14 pages.

Machine Translation and Abstract of Chinese Publication No. CN204614949, Sep. 2, 2015, 8 pages.

Foreign Communication From A Counterpart Application, PCT Application No. PCT/CN2016/083776, English Translation of International Search Report dated Feb. 14, 2017, 2 pages.

Foreign Communication From A Counterpart Application, PCT Application No. PCT/CN2016/083776, English Translation of Written Opinion dated Feb. 14, 2017, 7 pages.

Machine Translation and Abstract of Chinese Publication No. CN101957590, Jan. 26, 2011, 26 pages.

Foreign Communication From A Counterpart Application, Chinese Application No. 201680042416.7, Chinese Office Action dated Jul. 19, 2019, 8 pages.

* cited by examiner (a)

(b)

(a)

(b)

COMMUNICATIONS TERMINAL

CROSS-REFERENCE TO RELATED APPLICATIONS

This application is a U.S. National Stage of International Patent Application No. PCT/CN2016/083776 filed on May 28, 2016, which is hereby incorporated by reference in its entirety.

TECHNICAL FIELD

The present invention relates to the field of communications technologies, and in particular, to a communications terminal.

BACKGROUND

A multiple-input multiple-output (Multi-input Multi-output, MIMO) antenna adopts a design of multiple antennas that separately transmit and receive a signal, to increase a data throughput and a transmission distance of an antenna system. Therefore, MIMO antennas are widely applied in Universal Mobile Telecommunications System (Universal Mobile Telecommunications System, UMTS), a Long Term Evolution (Long Term Evolution, LTE) communications system, and a Wi-Fi communications system.

Among factors that affect MIMO antenna performance, an isolation between multiple antennas and antenna design space restrain each other. As communications terminals such as a mobile phone, a tablet computer, and a smartwatch are becoming ultra-thin, usually only small space is available for antenna design inside a terminal. For the MIMO antenna, however, small space means a short spatial distance between multiple antennas, and the isolation and radiation performance of the multiple antennas cannot be ensured. Therefore, a design of implementing a high-isolation MIMO antenna in small design space is key to improving radiation performance of the MIMO antenna and communication performance of a communications terminal.

SUMMARY

In view of prior-art problems, embodiments of the present invention provide a communications terminal, in which two separate feeds are used to generate currents orthogonal to each other to excite a same radiator to implement a MIMO antenna. This implements the design of a MIMO antenna in small design space while ensuring a good isolation of the MIMO antenna.

A first aspect of the embodiments of the present invention provides a communications terminal, including an antenna. The antenna includes a circuit board, a radiator, a first feed, a first coupling structure, a second feed, and a second coupling structure. The radiator is disposed around an outer edge of the circuit board, and a ring-shape slot is formed between the outer edge of the circuit board and the radiator. The first feed is electrically connected to the first coupling structure, the first coupling structure is coupled to the radiator along a first direction, and a current in a first polarization direction is formed on the circuit board by using the radiator and the ring-shape slot. The second feed is electrically connected to the second coupling structure, the second coupling structure is coupled to the radiator along a second direction, and a current in a second polarization direction is formed on the circuit board by using the radiator and the ring-shape slot. A specific included angle is formed between the first direction and the second direction.

The first feed and the second feed are disposed on the circuit board of the communications terminal, and the two feeds excite, by means of separate feeding, the radiator to work in a MIMO antenna mode. Because the two feeds share the radiator, a volume of a MIMO antenna can be reduced effectively. In addition, the first feed is coupled to the radiator by using the first coupling structure, a current in the first polarization direction is formed on the circuit board, the second feed is coupled to the radiator by using the second coupling structure, and a current in the second polarization direction is formed on the circuit board. Therefore, the antenna has a high isolation.

With reference to the first aspect, in a first possible implementation of the first aspect, the first coupling structure includes a first feed-in end and a first radiation arm, the first feed is electrically connected to the first radiation arm by using the first feed-in end, and a first coupling capacitor is formed between the first radiation arm and the radiator; and the second coupling structure includes a second feed-in end and a second radiation arm, the second feed is electrically connected to the second radiation arm by using the second feed-in end, and a second coupling capacitor is formed between the second radiation arm and the radiator.

With reference to the first aspect, in a second possible implementation of the first aspect, the first coupling structure includes a first coupling circuit, where one end of the first coupling circuit is electrically connected to the first feed, and the other end of the first coupling circuit is electrically connected to the radiator, to feed a current from the first feed into the radiator by means of coupling; and the second coupling structure includes a second coupling circuit, where one end of the second coupling circuit is electrically connected to the second feed, and the other end of the second coupling circuit is electrically connected to the radiator, to feed a current from the second feed into the radiator by means of coupling.

The first coupling circuit and the second coupling circuit are disposed to flexibly adjust a magnitude of the current coupled to the radiator by the first feed and/or the second feed. This facilitates adjustment of a resonance frequency and bandwidth of the antenna. Further, in comparison with a distributed capacitive coupling solution used in the first possible implementation of the first aspect, in this implementation, the feed-in ends or the radiation arms do not need to be disposed, and production costs of the antenna can be reduced.

With reference to the first aspect, the first possible implementation of the first aspect, or the second possible implementation of the first aspect, in a third possible implementation of the first aspect, a side of the circuit board opposite to the first coupling structure includes a first protrusion part, and a first capacitive load groove is formed between the first protrusion part and the radiator; a side of the circuit board opposite to the second coupling structure includes a second protrusion part, and a second capacitive load groove is formed between the second protrusion part and the radiator; and the first capacitive load groove and the second capacitive load groove are configured to implement capacitive loading between the radiator and the circuit board.

The first protrusion part and the second protrusion part are disposed on the circuit board to implement capacitive loading between the radiator and the circuit board. This helps improve the isolation of the antenna in different working modes and radiation performance of the antenna.

With reference to the third possible implementation of the first aspect, in a fourth possible implementation of the first aspect, the first protrusion part is electrically connected to the radiator by using a first tuned circuit, and/or the second protrusion part is electrically connected to the radiator by using a second tuned circuit, and the first tuned circuit and/or the second tuned circuit are/is configured to adjust a radiation property of the antenna.

The first tuned circuit between the first protrusion part and the radiator and/or the second tuned circuit between the second protrusion part and the radiator are/is disposed. Therefore, a magnitude of a coupled current between the first protrusion part and the radiator can be adjusted by using the first tuned circuit, and/or a magnitude of a coupled current between the second protrusion part and the radiator can be adjusted by using the second tuned circuit. This facilitates adjustment of the resonance frequency and the bandwidth of the antenna.

With reference to any one of the first aspect, or the first to the fourth possible implementations of the first aspect, in a fifth possible implementation of the first aspect, the circuit board further includes at least one opening and/or at least one stub, and the opening and/or the stub are/is disposed on an edge of the circuit board and are/is configured to adjust the isolation of the antenna in a first working mode and a second working mode.

The opening and/or the stub are disposed on the edge of the circuit board. This can improve the isolation of the antenna in different working modes, and help improve the radiation performance of the antenna.

With reference to the fifth possible implementation of the first aspect, in a sixth possible implementation of the first aspect, the circuit board includes two openings and two stubs. The two openings are disposed on opposite edges of the circuit board, the two stubs are disposed on opposite edges of the circuit board, and a line connecting the two stubs is orthogonal to a line connecting the two openings.

The line connecting the two openings is configured to be orthogonal to the line connecting the two stubs. This can further improve the isolation of the antenna in different working modes, and therefore improve the radiation performance of the antenna.

With reference to any one of the first aspect, or the first to the sixth possible implementations of the first aspect, in a seventh possible implementation of the first aspect, the current in the first polarization direction and the current in the second polarization direction are mutually quasi-orthogonal and complementary.

The current in the first polarization direction and the current in the second polarization direction are mutually quasi-orthogonal and complementary. Therefore, a coupling between the current in the first polarization direction and the current in the second polarization direction can be reduced. This improves an isolation of the radiator in the MIMO antenna mode and helps improve the radiation performance of the antenna.

With reference to any one of the first aspect, or the first to the seventh possible implementations of the first aspect, in an eighth possible implementation of the first aspect, the antenna further includes a dielectric layer, the dielectric layer is disposed at a bottom of the circuit board, and an outer edge of the dielectric layer is connected to the radiator for adjusting a radiation property of the antenna.

With reference to any one of the first aspect, or the first to the eighth possible implementations of the first aspect, in a ninth possible implementation of the first aspect, the circuit board is of a round pie structure and the radiator is of a ring structure; or the circuit board is of a rectangular block structure and the radiator is of a rectangular bezel structure; or the circuit board is of an oval pie structure and the radiator is of an oval ring structure.

A second aspect of the embodiments of the present invention provides a communications terminal, including an antenna. The antenna includes a circuit board, a radiator, a first feed, a first coupling structure, a second feed, and a second coupling structure. The radiator is disposed around an outer edge of the circuit board, and a ring-shape slot is formed between the outer edge of the circuit board and the radiator. The first feed is electrically connected to the first coupling structure and the second coupling structure. The first coupling structure is coupled to the radiator along a first direction, the second coupling structure is coupled to the radiator along a second direction, and a specific included angle is formed between the first direction and the second direction. A phase shifter is disposed between the first feed and the first coupling structure or between the first feed and the second coupling structure, and is configured to phase-shift a current from the first feed by a preset angle, so as to trigger a circular polarization working mode of the antenna.

The phase shifter is disposed between the first feed and the first coupling structure or between the first feed and the second coupling structure, so that the communications terminal can phase-shift the current fed in by the first feed to the first coupling structure or the second coupling structure for a specific angle, to facilitate the circular polarization working mode of the antenna. In comparison with the antenna provided in the first aspect of the embodiments of the present invention, the antenna in this aspect can be implemented by using only one feed and one phase shifter, features low costs and easy implementation, and can support more antenna working modes.

With reference to the second aspect, in a first possible implementation of the second aspect, the phase shifter is a 90-degree phase shifter and the preset angle is 90 degrees; or the phase shifter is a 270-degree phase shifter and the preset angle is 270 degrees.

The phase shifter is set to be a 90-degree or 270-degree phase shifter, so that the current from the first feed can be phase-shifted for 90 degrees or 270 degrees, and then a 90-degree phase difference is caused between a current fed into the radiator by the first coupling structure and a current fed into the radiator by the second coupling structure. The circular polarization working mode of the antenna can be implemented without changing the radiator, the circuit board, the first coupling structure, and the second coupling structure. This enriches working modes of the antenna.

With reference to the second aspect or the first possible implementation of the second aspect, in a second possible implementation of the second aspect, the antenna further includes a dielectric layer, the dielectric layer is disposed at a bottom of the circuit board, and an outer edge of the dielectric layer is connected to the radiator for adjusting a radiation property of the antenna.

With reference to the second aspect, the first possible implementation of the second aspect, or the second possible implementation of the second aspect, in a third possible implementation of the second aspect, the circuit board is of a round pie structure and the radiator is of a ring structure; or the circuit board is of a rectangular block structure and the radiator is of a rectangular bezel structure; or the circuit board is of an oval pie structure and the radiator is of an oval ring structure.

BRIEF DESCRIPTION OF DRAWINGS

To describe the technical solutions in the embodiments of the present invention more clearly, the following briefly describes the accompanying drawings required for describing the embodiments.

DESCRIPTION OF EMBODIMENTS

The following describes technical solutions in embodiments of the present invention with reference to accompanying drawings.

Figure 1:
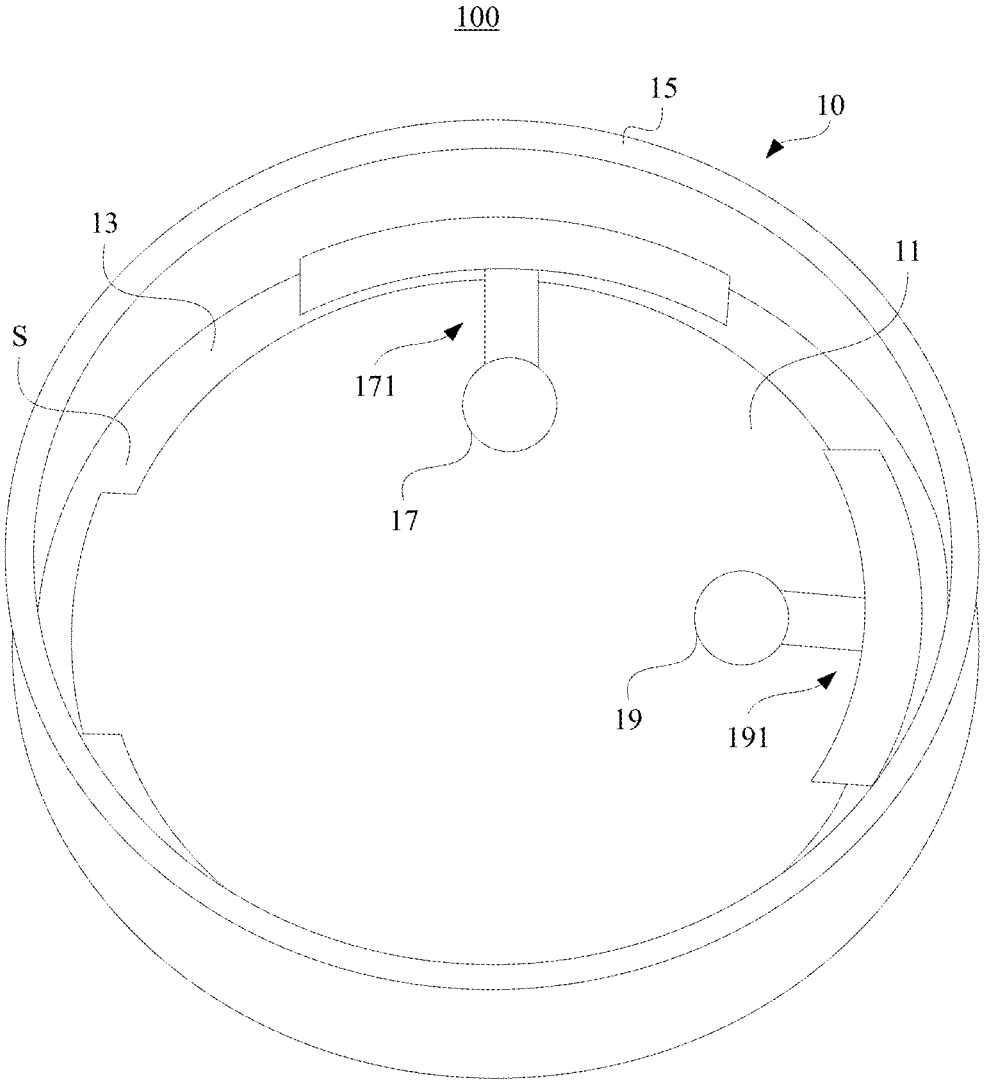
FIG. 1 is a three-dimensional schematic structural diagram of a communications terminal according to an embodiment of the present invention.
Figure 2:
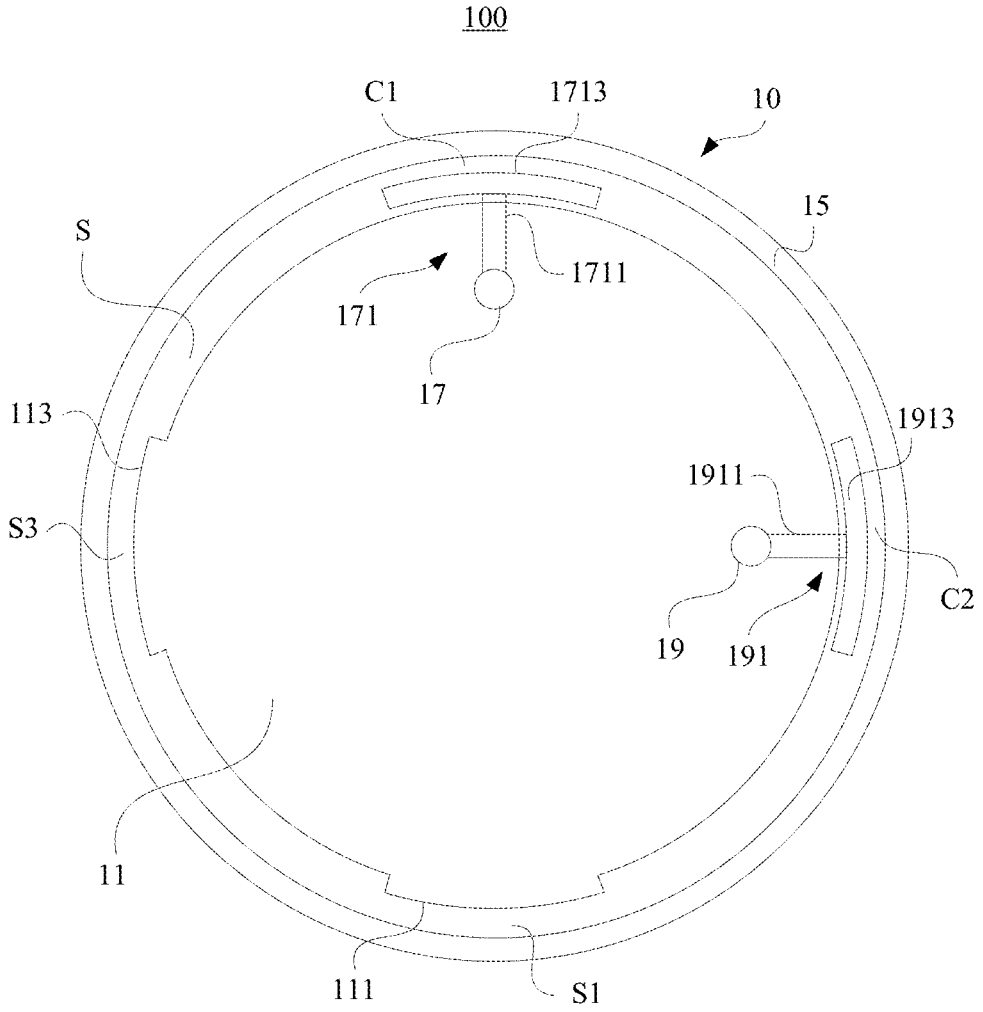
FIG. 2 is a schematic structural diagram of a first plane of a communications terminal according to an embodiment of the present invention.

Referring to both FIG. 1 and FIG. 2, in an embodiment of the present invention, a communications terminal 100 is provided, including an antenna 10. The antenna 10 includes a circuit board 11, a radiator 15, a first feed 17, a first coupling structure 171, a second feed 19, and a second coupling structure 191. The radiator 15 is disposed around an outer edge of the circuit board 11, and a ring-shape slot S is formed between the radiator 15 and the outer edge of the circuit board 11. Both the first feed 17 and the second feed 19 are disposed on the circuit board 11. The first feed 17 is electrically connected to the first coupling structure 171, and the first coupling structure 171 is coupled to the radiator 15 along a first direction. The first feed 17 is configured to provide a first excitation current, and a current in a first polarization direction is formed on the circuit board 11 by using the radiator 15 and the ring-shape slot S. The second feed 19 is electrically connected to the second coupling structure 191, and the second coupling structure 191 is coupled to the radiator 15 along a second direction. The second feed 19 is configured to provide a second excitation current, and a current in a second polarization direction is formed on the circuit board 11 by using the radiator 15 and the ring-shape slot S. A specific included angle is formed between the first direction and the second direction. In this embodiment, the circuit board 11 is in a round pie shape, and the radiator 15 is in a ring shape. Current feed-in directions of the first feed 17 and the second feed 19 are orthogonal to each other. That is, an included angle of 90 degrees is formed between the first direction and the second direction. It may be understood that orthogonal in the embodiments of the present invention may be non-strict orthogonal, for example, quasi-orthogonal (quasi-orthogonal). It may be understood that an electrical connection in the embodiments of the present invention may be a direct connection or a connection by way of another part or component.

The communications terminal 100 may be a smartwatch, a smart band, or the like. The radiator 15 may be a metal frame of the communications terminal 100. A slot antenna is formed between the radiator 15 and the circuit board 11 by using the ring-shape slot S. In the communications terminal 100, the first feed 17 and the second feed 19 are disposed on the circuit board 11, and the two feeds excite, by means of separate feeding, the antenna 10 to work in a multi-input multi-output (Multi-input Multi-output, MIMO) antenna mode. It may be understood that the first excitation current and the second excitation current have a same frequency and phase. For example, in this embodiment, the first excitation current and the second excitation current may be currents with a frequency being 2.4 GHz to 2.484 GHz and a same phase, and are used to excite the antenna 10 to work in the MIMO antenna mode at a Wi-Fi 2.4 GHz band. Alternatively, the first excitation current and the second excitation current may be currents with a frequency being 2.5 GHz to 2.69 GHz and a same phase, and are used to excite the antenna 10 to work in the MIMO antenna mode at an LTE Band 7.

The two feeds share the radiator 15, so that a volume of a MIMO antenna can be effectively reduced. That is, in limited antenna design space, a form of sharing a radiator can be used to implement the MIMO antenna, so as to mitigate an effect of design space on the MIMO antenna. In addition, the first feed 17 is coupled to the radiator 15 by using the first coupling structure 171, and a current in the first polarization direction is formed on the circuit board 11 by using the radiator 15 and the ring-shape slot S. The second feed 19 is coupled to the radiator 15 by using the second coupling structure 191, and a current in the second polarization direction is formed on the circuit board 11 by using the radiator 15 and the ring-shape slot S. Moreover, the first polarization direction and the second polarization direction are quasi-orthogonal. Therefore, an isolation of the antenna 10 in the MIMO antenna mode can be effectively improved. It may be understood that by means of adjusting feed-in positions of the first feed 17 and the second feed 19 on the radiator 15, a relationship between the current in the first polarization direction and the current in the second polarization direction can be adjusted, and then the isolation of the antenna 10 in the MIMO antenna mode is adjusted.

Figure 3:
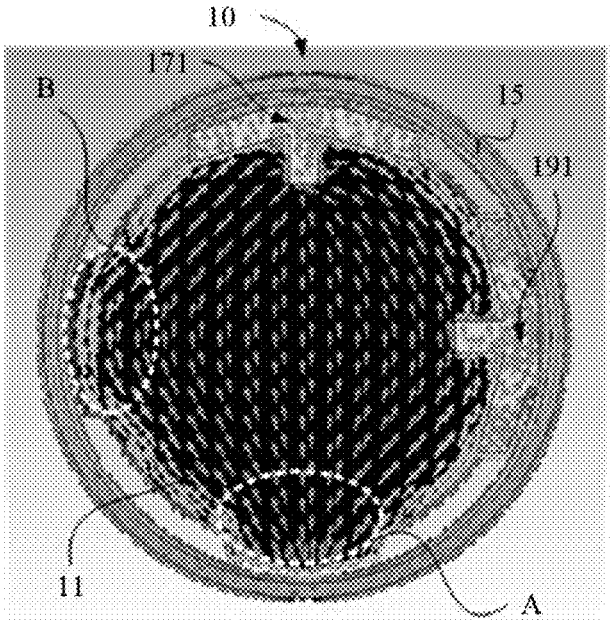
FIG. 3 is a schematic diagram of current distribution in an antenna of a communications terminal according to an embodiment of the present invention.
Figure 3:
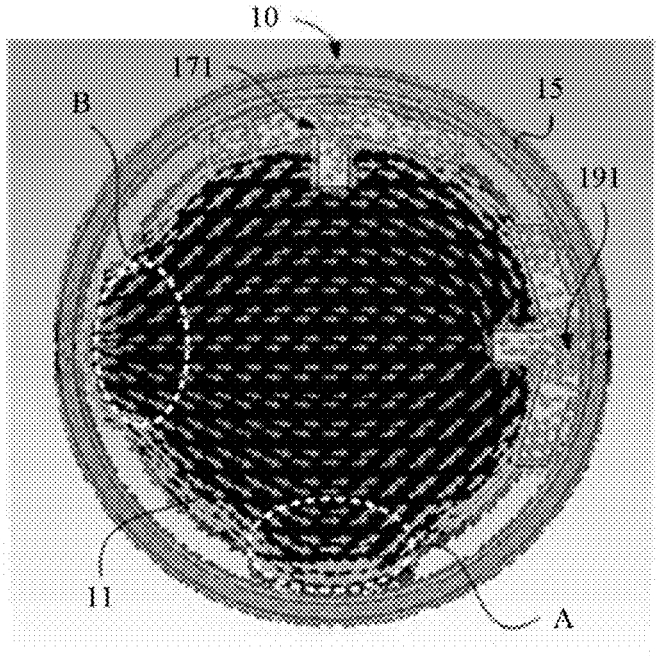

Referring to FIG. 3, FIG. 3 is a schematic diagram of current distribution in the antenna 10. FIG. 3(*a*) is a schematic diagram illustrating distribution of a current formed by coupling the first excitation current to the radiator 15 and the current in the first polarization direction formed on the circuit board 11. FIG. 3(*b*) is a schematic diagram illustrating distribution of a current formed by coupling the second excitation current to the radiator 15 and the current in the second polarization direction formed on the circuit board 11. It can be learnt from a comparison of FIG. 3(*a*) and FIG. 3(*b*), the first excitation current is coupled to the radiator 15 through the first coupling structure 171 and flows in clockwise and counter-clockwise directions on the radiator 15, so that the radiator 15 resonates with the circuit board 11 by using the ring-shape slot S, and a current in the first polarization direction is formed on the circuit board 11. The first coupling structure 171 is coupled to the radiator 15 along the first direction. The first direction is a direction from the first feed 17, the first coupling structure 171, to the radiator 15. The first polarization direction formed on the circuit board 11 is the same as or close to the first direction. The second excitation current is coupled to the radiator 15 through the second coupling structure 191 and flows in clockwise and counter-clockwise directions on the radiator 15, so that the radiator 15 resonates with the circuit board 11 by using the ring-shape slot S, and a current in the second polarization direction is formed on the circuit board 11. The second coupling structure 191 is coupled to the radiator 15 along the second direction. The second direction is a direction from the second feed 19, the second coupling structure 191, to the radiator 15. The second polarization direction formed on the circuit board 11 is the same as or close to the second direction. In this embodiment, the current in the first polarization direction and the current in the second polarization direction on the circuit board 11 are quasi-orthogonal and complementary to each other, so that a good isolation is achieved for the antenna 10 in the MIMO antenna mode.

That the current in the first polarization direction and the current in the second polarization direction are quasi-orthogonal to each other means: a flow direction of the current in the first polarization direction on the circuit board 11 is approximately perpendicular to a flow direction of the current in the second polarization direction on the circuit board 11. That the current in the first polarization direction and the current in the second polarization direction are complementary to each other means: a position in which the current in the first polarization direction on the circuit board 11 reaches its greatest magnitude is exactly a position in which the current in the second polarization direction on the circuit board drops to its least magnitude, and therefore the currents are mutually complementary. For example, a magnitude of the current in the first polarization direction is the least in a position A shown in FIG. 3(*a*), a magnitude of the current in the second polarization direction is the greatest in the same position A shown in FIG. 3(*b*), and therefore, the currents are complementary. Likewise, the magnitude of the current in the first polarization direction is the greatest in a position B shown in FIG. 3(*a*), the magnitude of the current in the second polarization direction is the least in the same position B shown in FIG. 3(*b*), and therefore, the currents are complementary. In this embodiment, the first polarization direction is a vertical direction, and the second polarization direction is a horizontal direction.

Still referring to FIG. 1, the radiator 15 may have a specific height in a direction vertical to the circuit board 11. For example, the radiator 15 may extend towards the circuit board 11 side along the direction vertical to the circuit board 11, so that a specific height is formed in the direction vertical to the circuit board 11. It may be understood that a radiation property of the antenna 10, such as a resonance frequency and a bandwidth, may be adjusted by adjusting parameters such as a radius, a height, and a thickness of the radiator 15, a width of the ring-shape slot S, and a radius and a thickness of the circuit board 11. In addition, in an optional implementation, the antenna 10 may further include a dielectric layer 13. The dielectric layer 13 is disposed at a bottom of the circuit board 11, and an outer edge of the dielectric layer 13 is connected to the radiator 15. In this embodiment, the dielectric layer 13 is also in a round pie shape, and a radius of the dielectric layer 13 is the same as an outer diameter of the radiator 15. It may be understood that the radiation property of the antenna 10, such as a resonance frequency and a bandwidth, may be adjusted by adjusting a dielectric parameter of the dielectric layer 13.

Figure 4:
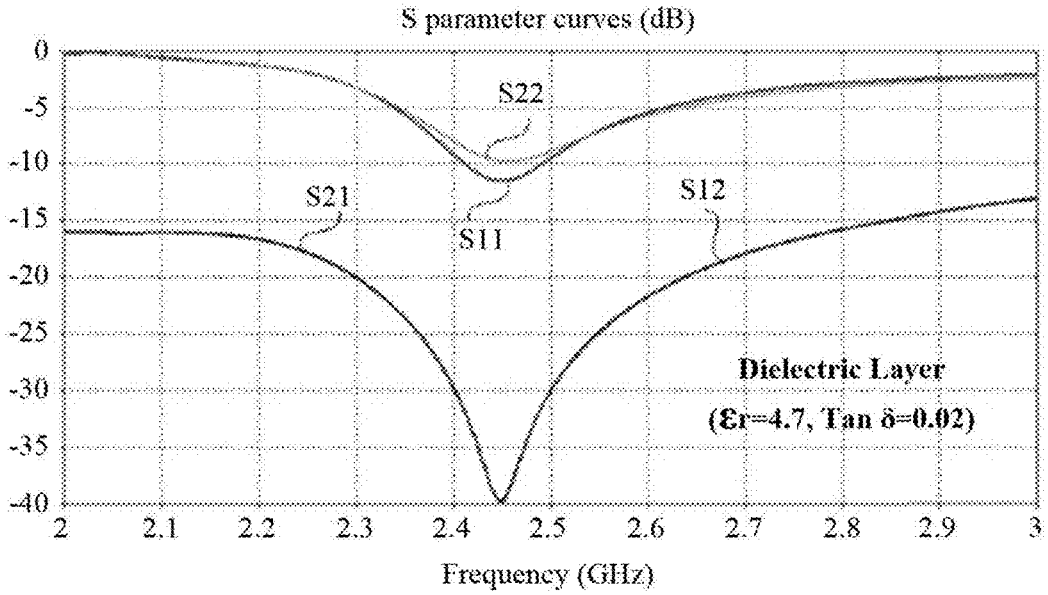
FIG. 4 is a schematic diagram of a scattering parameter curve of an antenna of a communications terminal according to an embodiment of the present invention.
Figure 4:
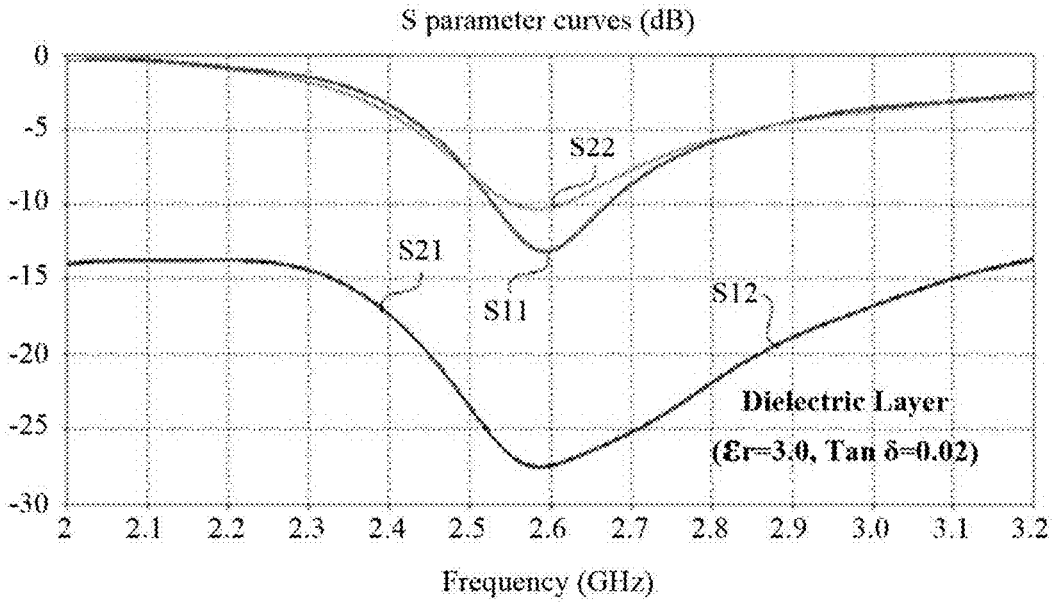

Referring to FIG. 4, FIG. 4 is a schematic diagram of S parameter curves of the antenna 10 when different dielectric parameters are used. FIG. 4(*a*) shows S parameter curves S11, S12, S21, and S22 of the antenna 10 when a value of a dielectric constant εr of the dielectric layer (Dielectric Layer) 13 is 4.7 and a value of a dielectric loss tangent Tan δ is 0.02, where S12 and S21 coincide. FIG. 4(*b*) shows S parameter curves S11, S12, S21, and S22 of the antenna 10 when a value of the dielectric constant εr of the dielectric layer 13 is 3.0 and a value of the dielectric loss tangent Tan δ is 0.02, where S12 and S21 coincide. It can be learnt from FIG. 4 that when two different dielectric parameters are used and the antenna 10 operates at an operating bandwidth in case that values of the S parameter S11 and the S parameter S22 are smaller than −6 dB, an antenna isolation (the S parameter S12 and the S parameter S21) can be below −20 dB, that is, the antenna 10 has a high isolation in the MIMO antenna mode. It may be understood that in an optional case, the value of the dielectric constant εr of the dielectric layer 13 may be set to 1.0 and the value of the dielectric loss tangent Tan δ may be set to 0, so that the dielectric layer 13 does not affect the radiation property of the antenna 10. Still referring to FIG. 2, in an optional implementation, the first coupling structure 171 includes a first feed-in end 1711 and a first radiation arm 1713, the first feed 17 is electrically connected to the first radiation arm 1713 by using the first feed-in end 1711, and a first coupling capacitor C1 is formed between the first radiation arm 1713 and the radiator 15; and the second coupling structure 191 includes a second feed-in end 1911 and a second radiation arm 1913, the second feed 19 is electrically connected to the second radiation arm 1913 by using the second feed-in end 1911, and a second coupling capacitor C2 is formed between the second radiation arm 1913 and the radiator 15. It may be understood that the first coupling capacitor C1 and the second coupling capacitor C2 are distributed capacitors. A resonance frequency of the antenna 10 may be adjusted by adjusting a length of the first radiation arm 1713 and/or the second radiation arm 1913, a distance between the first radiation arm 1713 and the radiator 15, and/or a distance between the second radiation arm 1913 and the radiator 15. In this embodiment, a T-shape connection is established between the first feed-in end 1711 and the first radiation arm 1713, a T-shape connection is established between the second feed-in end 1911 and the second radiation arm 1913, and the first feed-in end 1711 is perpendicular to the second feed-in end 1911.

Figure 5:
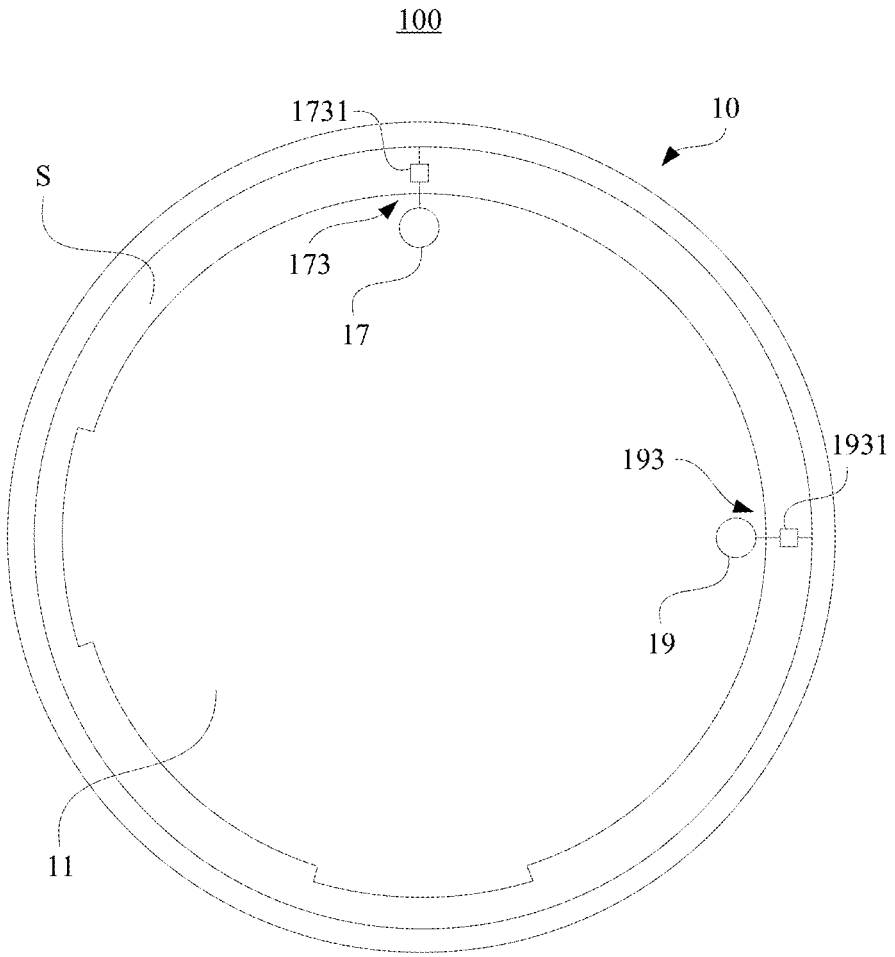
FIG. 5 is a schematic structural diagram of a second plane of a communications terminal according to an embodiment of the present invention.

Referring to FIG. 5, in an optional implementation, the first feed 17 is coupled to the radiator 15 by using a first coupling structure 173, and the second feed 19 is coupled to the radiator 15 by using a second coupling structure 193. The first coupling structure 173 includes a first coupling circuit 1731. One end of the first coupling circuit 1731 is electrically connected to the first feed 17, and the other end of the first coupling circuit 1731 is electrically connected to the radiator 15, to feed a current of the first feed 17 into the radiator 15 by means of coupling. The second coupling structure 193 includes a second coupling circuit 1931. One end of the second coupling circuit 193 is electrically connected to the second feed 19, and the other end of the second coupling circuit 193 is electrically connected to the radiator 15, to feed a current of the second feed 19 into the radiator 15 by means of coupling. In this embodiment, both the first coupling circuit 1731 and the second coupling circuit 1931 may be fixed capacitors or variable capacitors. It may be understood that a resonance frequency of the antenna 10 can be adjusted by adjusting capacitance values of the fixed capacitors or the variable capacitors. In this optional implementation, the first coupling structure 171 used in the implementation illustrated in FIG. 2 is replaced with the first coupling circuit 1731, and the second coupling structure 191 used in the implementation illustrated in FIG. 2 is replaced with the second coupling circuit 1931. That is, the distributed capacitors used in the implementation illustrated in FIG. 2 are replaced with the fixed capacitors or the variable capacitors. Therefore, the resonance frequency and bandwidth of the antenna 10 can be adjusted flexibly and production costs of the antenna 10 can be reduced.

Still referring to FIG. 2, in an optional implementation, a side of the circuit board 11 opposite to the first coupling structure 171 includes a first protrusion part 111. A first capacitive load groove S1 is formed between the first protrusion part 111 and the radiator 15, and a first capacitive loading structure is formed between the first protrusion part 111 and the first capacitive load groove S1. A side of the circuit board 11 opposite to the second coupling structure 191 includes a second protrusion part 113. A second capacitive load groove S3 is formed between the second protrusion part 113 and the radiator 15, and a second capacitive loading structure is formed between the second protrusion part 113 and the second capacitive load groove S3. The first capacitive load groove S1 and the second capacitive load groove S3 are configured to implement capacitive loading between the radiator 15 and the circuit board 11. In this optional implementation, the first protrusion part 111 is disposed on the side of the circuit board 11 opposite to the first coupling structure 171, so that a distance between the circuit board 11 and the radiator 15 is reduced, the first capacitive load groove S1 is formed between the circuit board 11 and the radiator 15, and a current of the radiator 15 can be coupled to the circuit board 11 in a position of the first capacitive load groove S1, so as to form a first current loop. In addition, the second protrusion part 113 is disposed on the side of the circuit board 11 opposite to the second coupling structure 191, so that the distance between the circuit board 11 and the radiator 15 is reduced, the second capacitive load groove S2 is formed between the circuit board 11 and the radiator 15, and the current of the radiator 15 can be coupled to the circuit board 11 in a position of the second capacitive load groove S2, so as to form a second current loop. Because a position of the first protrusion part 111 is opposite to the first coupling structure 171 and a position of the second protrusion part 113 is opposite to the second coupling structure 191, a current on the first current loop is orthogonal to a current on the second current loop. Therefore, the isolation of the antenna 10 in the MIMO antenna mode can be effectively improved.

Figure 6:
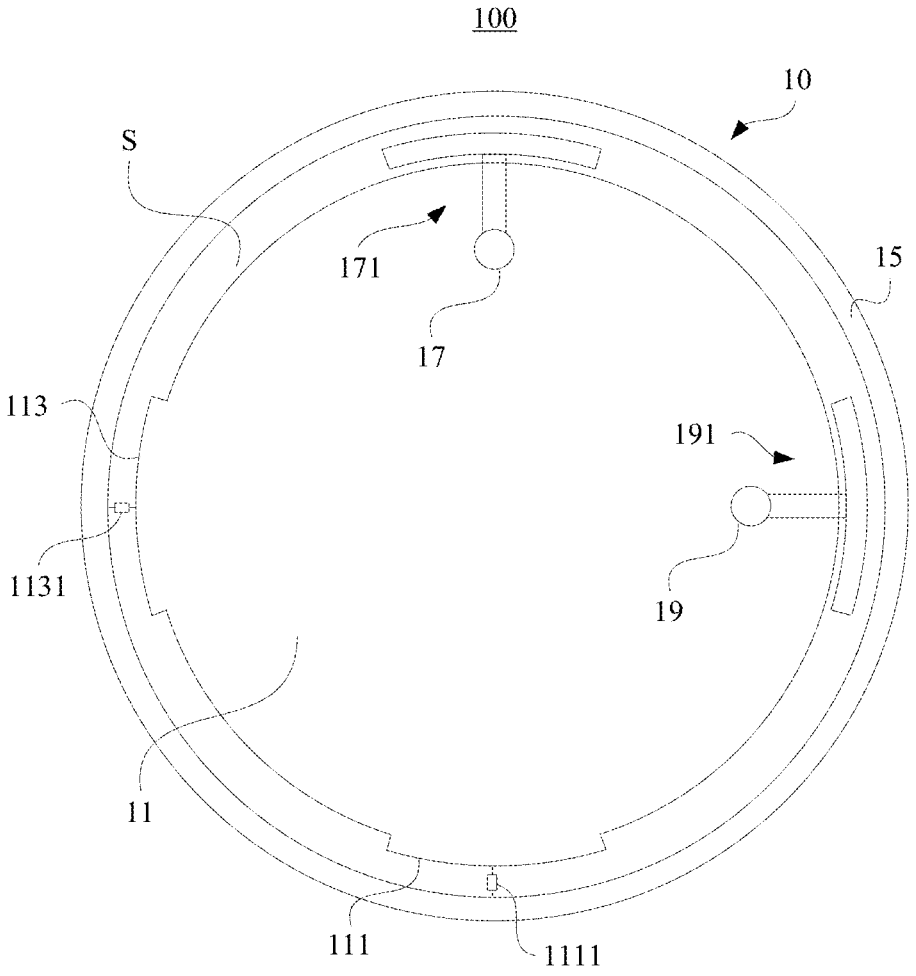
FIG. 6 is a schematic structural diagram of a third plane of a communications terminal according to an embodiment of the present invention.
Figure 7:
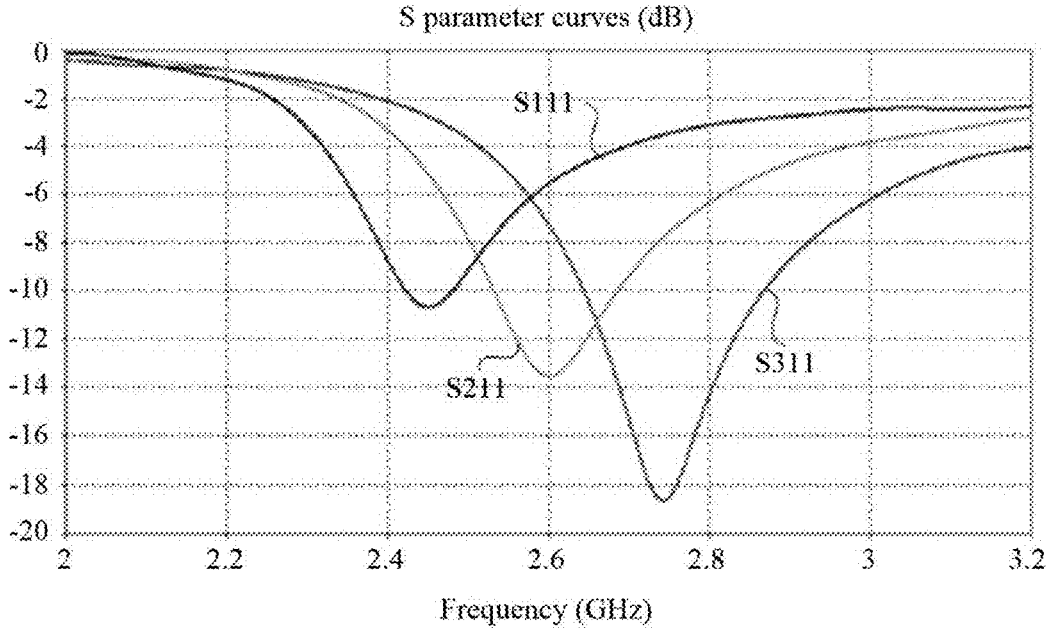
FIG. 7 is a schematic diagram of a return loss curve of an antenna of a communications terminal according to an embodiment of the present invention.
Figure 8:
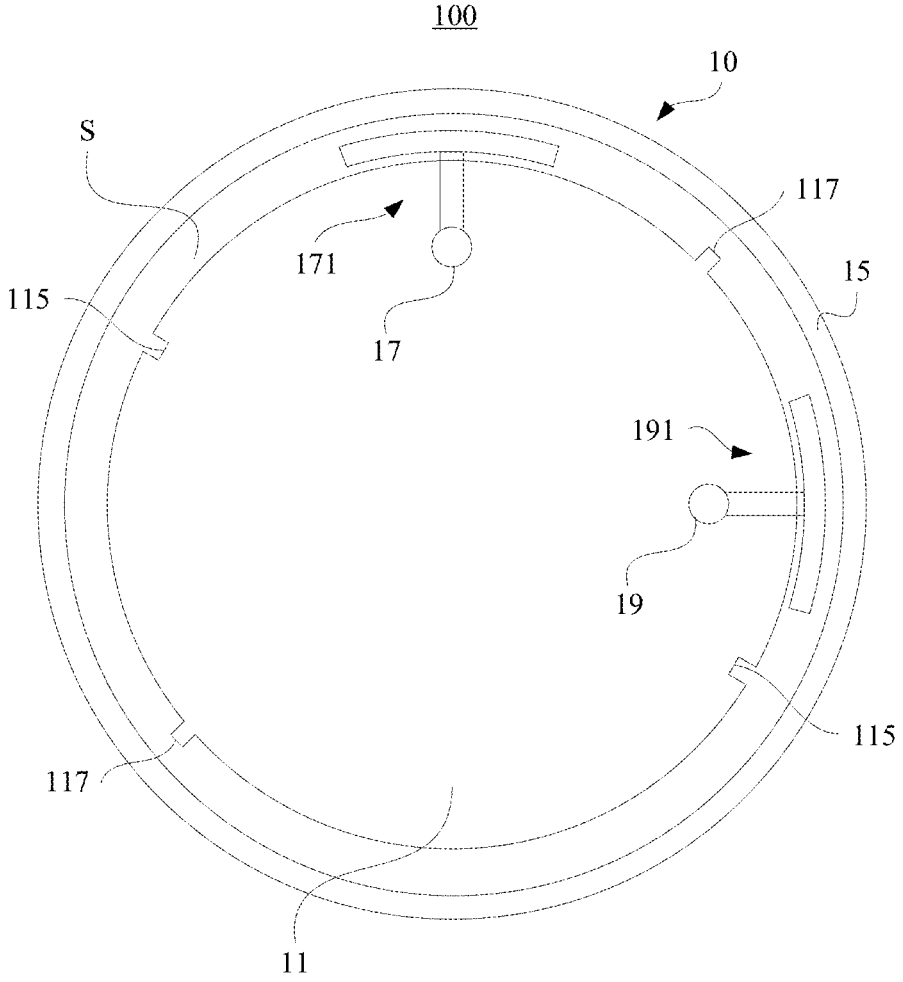
FIG. 8 is a schematic structural diagram of a fourth plane of a communications terminal according to an embodiment of the present invention.

Referring to FIG. 6, in an optional implementation, the first protrusion part 111 is electrically connected to the radiator 15 by using a first tuned circuit 1111, and/or the second protrusion part 113 is electrically connected to the radiator 15 by using a second tuned circuit 1131. The first tuned circuit 1111 and/or the second tuned circuit 1131 are/is configured to adjust the resonance frequency and the bandwidth of the antenna 10. It may be understood that the first tuned circuit 1111 and the second tuned circuit 1131 may include components such as a capacitor and an inductor. For example, the tuned circuit may include a switch and a fixed capacitor or an inductor, and a value of load capacitance or a value of inductance between the protrusion part and the radiation 15 can be adjusted by turning on or off the switch. Alternatively, the tuned circuit also includes a variable capacitor, and the value of load capacitance between the protrusion part and the radiator 15 can be adjusted by adjusting a capacitance value of the variable capacitor. Therefore, the resonance frequency and the bandwidth of the antenna 10 can be further adjusted. Referring to FIG. 7, FIG. 7 shows an S parameter curve of the antenna 10 when the first tuned circuit 1111 and the second tuned circuit 1131 use different compositions and parameters, and an S parameter curve of the antenna 10 when the first tuned circuit 1111 and the second tuned circuit 1131 are not included. A curve S111 is an S parameter curve of the antenna 10 when a capacitance C of the first tuned circuit 1111 and the second tuned circuit 1131 is 0.2 pF. A curve S211 is an S parameter curve of the antenna 10 when the first tuned circuit 1111 and the second tuned circuit 1131 are not included. A curve S311 is an S parameter curve of the antenna 10 when an inductance L of the first tuned circuit 1111 and the second tuned circuit 1131 is 20 nH. In this implementation, the S parameter curve is a return loss curve. It can be learnt from FIG. 7 that the resonance frequency and the bandwidth of the antenna 10 can be flexibly adjusted by disposing the first tuned circuit 1111 and the second tuned circuit 1131 and changing compositions and parameters of the first tuned circuit 1111 and the second tuned circuit 1131. Referring to FIG. 8, in an optional implementation, the circuit board 11 further includes at least one opening 115 and/or at least one stub 117. The opening 115 and/or the stub 117 are/is disposed on an edge of the circuit board 11 and are/is configured to adjust the isolation of the antenna 10 in the MIMO antenna mode. In this implementation, the circuit board 11 includes two openings 115 and two stubs 117. The two openings 115 are disposed on opposite edges of the circuit board 11, and one of the openings 115 is located between the first coupling structure 171 and the second coupling structure 191. The two stubs are disposed on opposite edges of the circuit board 11. A line connecting the two stubs 117 is orthogonal to a line connecting the two openings 115. It may be understood that quantities and locations of the openings 115 and the stubs 117 may be adjusted according to a requirement for the antenna isolation. In addition, the opening 115 and the stub 117 may coexist with the first protrusion part 111 and the second protrusion part 113 used in the implementation in FIG. 2.

Figure 9:
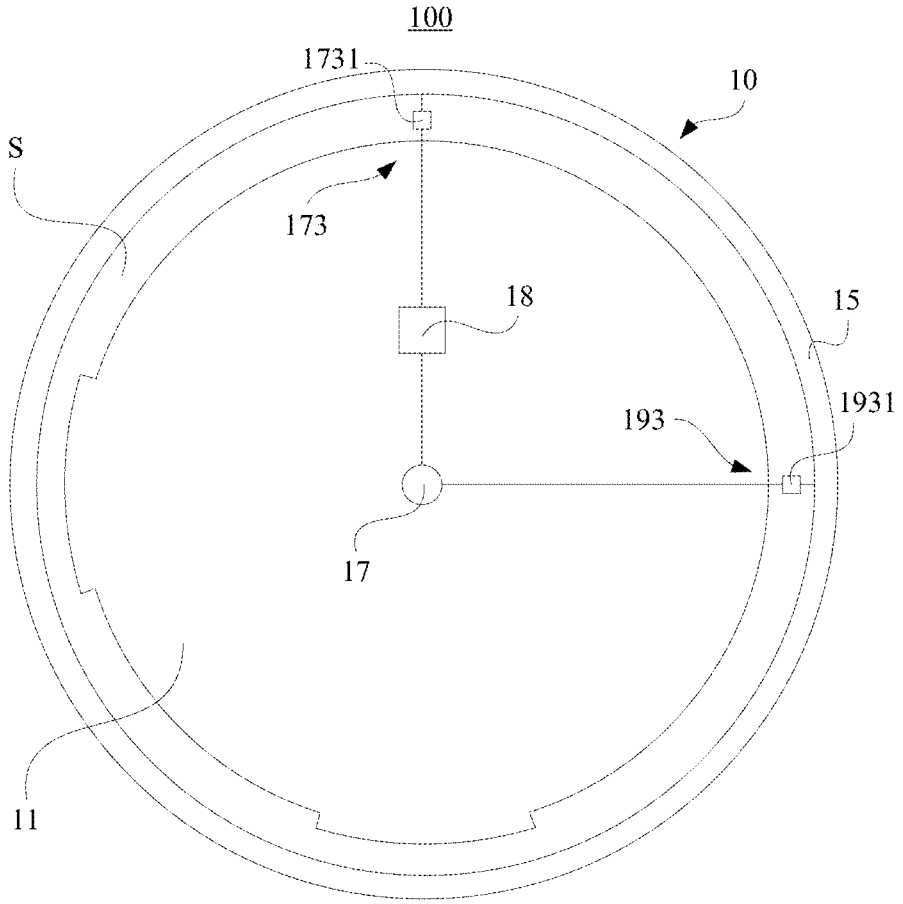
FIG. 9 is a schematic structural diagram of a fifth plane of a communications terminal according to an embodiment of the present invention.

Referring to FIG. 9, in an embodiment of the present invention, an antenna 10 may be used to transmit and receive a circular polarization wave. Specifically, an only difference between the antenna 10 in this embodiment and the antenna 10 shown in FIG. 1, FIG. 2, FIG. 5, FIG. 6, or FIG. 8 lies in that: the antenna 10 in this embodiment may include only a first feed 17, or further includes a phase shifter 18. The first feed 17 is coupled to a radiator 15 along a first direction by using a first coupling structure 171 (173), and coupled to the radiator 15 along a second direction by using a second coupling structure 191 (193). A specific included angle is formed between the first direction and the second direction. The phase shifter 18 is disposed between the first feed 17 and the first coupling structure 171 (173) or between the first feed 17 and the second coupling structure 191 (193), and is configured to phase-shift a current from the first feed 17 by a preset angle, so as to trigger a circular polarization working mode 2 of the antenna 10. In this embodiment, an included angle of 90 degrees is formed between the first direction and the second direction. The phase shifter 18 is a 90-degree phase shifter and the preset angle is 90 degrees; or the phase shifter 18 is a 270-degree phase shifter and the preset angle is 270 degrees.

Figure 10:
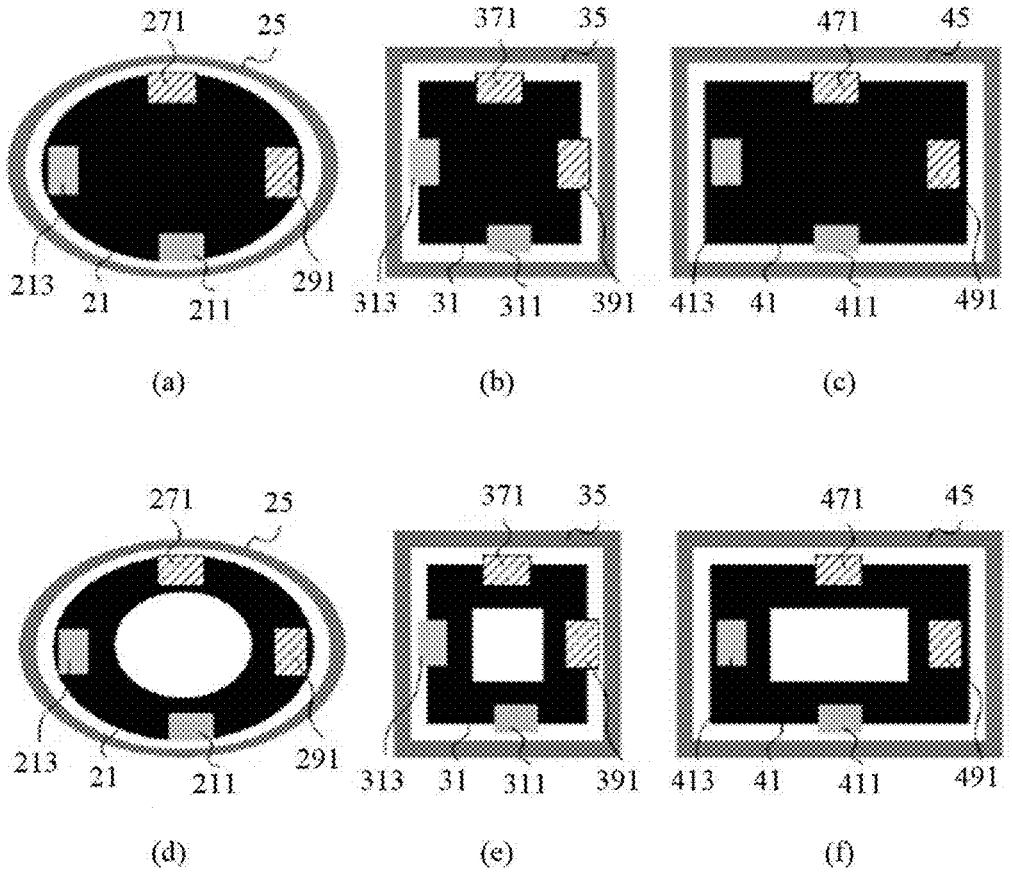
FIG. 10 is a schematic structural diagram of an optional plane of a communications terminal according to an embodiment of the present invention.

Referring to FIG. 10, in an optional implementation, the antenna is not limited to the circular structure shown in FIG. 1 and may be of a structure such as an oval, a square, or a rectangle. Specifically, in an optional implementation, the antenna may be of an oval structure shown in FIG. 10(*a*). A circuit board 21 is of an oval pie structure, a radiator 25 is of an oval ring structure, 271 represents a first feed, 291 represents a second feed, 211 represents a first capacitive loading structure, and 213 represents a second capacitive loading structure. Current feed-in directions of the first feed 271 and the second feed 291 are orthogonal to each other. The first capacitive loading structure 211 is disposed on a side of the circuit board 21 opposite to the first feed 271, and the second loading structure 213 is disposed on a side of the circuit board 21 opposite to the second feed 291. It may be understood that the circuit board 21 may alternatively be of an oval ring structure, as shown in FIG. 10(*d*).

In an optional implementation, the antenna may be of a square structure shown in FIG. 10(*b*). A circuit board 31 is of a square block structure, a radiator 35 is of a square bezel structure, 371 represents a first feed, 391 represents a second feed, 311 represents a first capacitive loading structure, and 313 represents a second capacitive loading structure. Current feed-in directions of the first feed 371 and the second feed 391 are orthogonal to each other. The first capacitive loading structure 311 is disposed on a side of the circuit board 31 opposite to the first feed 371, and the second loading structure 313 is disposed on a side of the circuit board 31 opposite to the second feed 391. It may be understood that the circuit board 31 may alternatively be of a square bezel structure, as shown in FIG. 10(*e*).

In an optional implementation, the antenna may be of a rectangular structure shown in FIG. 10(*c*). A circuit board 41 is of a rectangular block structure, a radiator 45 is of a rectangular bezel structure, 471 represents a first feed, 491 represents a second feed, 411 represents a first capacitive loading structure, and 413 represents a second capacitive loading structure. Current feed-in directions of the first feed 471 and the second feed 491 are orthogonal to each other. The first capacitive loading structure 411 is disposed on a side of the circuit board 41 opposite to the first feed 471, and the second loading structure 413 is disposed on a side of the circuit board 41 opposite to the second feed 491. It may be understood that the circuit board 41 may be of a rectangular bezel structure, as shown in FIG. 10(*f*).

It may be understood that the various antenna shapes shown in FIG. 10 may also be applied to the implementation shown in FIG. 9, in which the antenna 10 is used to transmit and receive a circular polarization wave. Only one feed needs to be reserved, and the phase shifter 18 needs to be disposed between the feed and the first coupling structure 171 (173) or between the feed and the second coupling structure 191 (193). For a specific description, reference may be made to the implementation shown in FIG. 9, and details are not described herein again.

What is disclosed above is merely exemplary embodiments of the present invention, and certainly is not intended to limit the protection scope of the present invention. A person of ordinary skill in the art may understand that all or some of processes that implement the foregoing embodiments and equivalent modifications made in accordance with the claims of the present invention shall fall within the scope of the present invention.

The invention claimed is:

1. An antenna comprising:

a circuit board comprising a first side and a second side, wherein the first side comprises a first protrusion part, and wherein the second side comprises a second protrusion part;

a radiator disposed around an outer edge of the circuit board, wherein a ring-shape slot is formed between the outer edge of the circuit board and the radiator, wherein a first current in a first polarization direction is formed on the circuit board using the radiator and the ring-shape slot, and wherein a second current in a second polarization direction is formed on the circuit board using the radiator and the ring-shape slot;

a first coupling structure coupled to the radiator along a first direction, wherein the first side is opposite to the first coupling structure;

a first feed electrically coupled to the first coupling structure;

a second coupling structure coupled to the radiator along a second direction, wherein the second side is opposite to the second coupling structure;

a second feed electrically coupled to the second coupling structure, wherein a specific included angle is formed between the first direction and the second direction;

a first capacitive load groove formed between the first protrusion part and the radiator; and a second capacitive load groove formed between the second protrusion part and the radiator, wherein the first capacitive load groove and the second capacitive load groove are configured to implement capacitive loading between the radiator and the circuit board.

2. The antenna of claim 1, wherein the first coupling structure comprises:

a first feed-in end;

a first radiation arm, wherein the first feed is electrically coupled to the first radiation arm using the first feed-in end;

a first coupling capacitor formed between the first radiation arm and the radiator, wherein the second coupling structure comprises a second feed-in end and a second radiation arm, and wherein the second feed is electrically coupled to the second radiation arm using the second feed-in end; and a second coupling capacitor formed between the second radiation arm and the radiator.

3. The antenna of claim 1, wherein the first coupling structure comprises a first coupling circuit, wherein one end of the first coupling circuit is electrically coupled to the first feed and the other end of the first coupling circuit is electrically coupled to the radiator to feed a third current from the first feed into the radiator by coupling, wherein the second coupling structure comprises a second coupling circuit, and wherein one end of the second coupling circuit is electrically coupled to the second feed and the other end of the second coupling circuit is electrically coupled to the radiator to feed a fourth current from the second feed into the radiator by coupling.

4. The antenna of claim 1, wherein the first protrusion part is electrically coupled to the radiator using a first tuned circuit, wherein the second protrusion part is electrically coupled to the radiator using a second tuned circuit, and wherein the first tuned circuit and the second tuned circuit are configured to adjust a radiation property of the antenna.

5. The antenna of claim 1, wherein the first protrusion part is electrically coupled to the radiator using a first tuned circuit, and wherein the first tuned circuit is configured to adjust a radiation property of the antenna.

6. The antenna of claim 1, wherein the second protrusion part is electrically coupled to the radiator using a second tuned circuit, and wherein the second tuned circuit is configured to adjust a radiation property of the antenna.

7. The antenna of claim 1, wherein the circuit board further comprises at least one opening and at least one stub, and wherein the at least one opening and the at least one stub are disposed on an edge of the circuit board and are configured to adjust an isolation of the antenna.

8. The antenna of claim 1, wherein the circuit board further comprises at least one opening or at least one stub, and wherein the at least one opening or the at least one stub is disposed on an edge of the circuit board and is configured to adjust an isolation of the antenna.

9. The antenna of claim 1, wherein the first current in the first polarization direction and the second current in the second polarization direction are mutually quasi-orthogonal and complementary.

10. The antenna of claim 1, further comprising a dielectric layer, wherein the dielectric layer is disposed at a bottom of the circuit board, and wherein an outer edge of the dielectric layer is coupled to the radiator for adjusting a radiation property of the antenna.

11. The antenna of claim 1, wherein the antenna is a multi-input multi-output antenna.

12. The antenna of claim 1, wherein the first current in the first polarization direction and the second current in the second polarization direction have a same frequency.

13. A terminal comprising:

a body; and an antenna system supported by the body, wherein the antenna system comprises a plurality of antennas, and wherein each antenna comprises:

a circuit board comprising a first side and a second side, wherein the first side comprises a first protrusion part, and wherein the second side comprises a second protrusion part;

a radiator disposed around an outer edge of the circuit board, wherein a ring-shape slot is formed between the outer edge of the circuit board and the radiator, wherein a first current in a first polarization direction is formed on the circuit board using the radiator and the ring-shape slot, and wherein a second current in a second polarization direction is formed on the circuit board using the radiator and the ring-shape slot;

a first coupling structure coupled to the radiator along a first direction, wherein the first side is opposite to the first coupling structure;

a first feed electrically coupled to the first coupling structure;

a second coupling structure coupled to the radiator along a second direction, wherein the second side is opposite to the second coupling structure;

a second feed electrically coupled to the second coupling structure, wherein a specific included angle is formed between the first direction and the second direction;

a first capacitive load groove formed between the first protrusion part and the radiator; and a second capacitive load groove formed between the second protrusion part and the radiator, wherein the first capacitive load groove and the second capacitive load groove are configured to implement capacitive loading between the radiator and the circuit board.

14. The terminal of claim 13, wherein the first coupling structure comprises:

a first feed-in end;

a first radiation arm, wherein the first feed is electrically coupled to the first radiation arm using the first feed-in end;

a first coupling capacitor formed between the first radiation arm and the radiator, wherein the second coupling structure comprises a second feed-in end and a second radiation arm, and wherein the second feed is electrically coupled to the second radiation arm using the second feed-in end; and a second coupling capacitor formed between the second radiation arm and the radiator.

15. The terminal of claim 13, wherein the first coupling structure comprises a first coupling circuit, wherein one end of the first coupling circuit is electrically coupled to the first feed and the other end of the first coupling circuit is electrically coupled to the radiator to feed a third current from the first feed into the radiator by coupling, wherein the second coupling structure comprises a second coupling circuit, and wherein one end of the second coupling circuit is electrically coupled to the second feed and the other end of the second coupling circuit is electrically coupled to the radiator to feed a fourth current from the second feed into the radiator by coupling.

16. The terminal of claim 13, wherein the first protrusion part is electrically coupled to the radiator using a first tuned circuit, wherein the second protrusion part is electrically coupled to the radiator using a second tuned circuit, and wherein the first tuned circuit and the second tuned circuit are configured to adjust a radiation property of each antenna.

17. The terminal of claim 13, wherein the first protrusion part is electrically coupled to the radiator using a first tuned circuit, and wherein the first tuned circuit is configured to adjust a radiation property of each antenna.

18. The terminal of claim 13, wherein the second protrusion part is electrically coupled to the radiator using a second tuned circuit, and wherein the second tuned circuit is configured to adjust a radiation property of each antenna.

19. The terminal of claim 13, wherein the circuit board further comprises at least one opening and at least one stub, and wherein the at least one opening and the at least one stub are disposed on an edge of the circuit board and are configured to adjust an isolation of each antenna.

20. A multi-input multi-output antenna system comprising:

a plurality of antennas, wherein each antenna comprises:

a circuit board comprising a first side and a second side, wherein the first side comprises a first protrusion part, and wherein the second side comprises a second protrusion part;

a radiator disposed around an outer edge of the circuit board, wherein a ring-shape slot is formed between the outer edge of the circuit board and the radiator, wherein a first current in a first polarization direction is formed on the circuit board using the radiator and the ring-shape slot, and wherein a second current in a second polarization direction is formed on the circuit board using the radiator and the ring-shape slot;

a first coupling structure coupled to the radiator along a first direction, wherein the first side is opposite to the first coupling structure;

a first feed electrically coupled to the first coupling structure;

a second coupling structure coupled to the radiator along a second direction, wherein the second side is opposite to the second coupling structure;

a second feed electrically coupled to the second coupling structure, wherein a specific included angle is formed between the first direction and the second direction;

a first capacitive load groove formed between the first protrusion part and the radiator; and a second capacitive load groove formed between the second protrusion part and the radiator, wherein the first capacitive load groove and the second capacitive load groove are configured to implement capacitive loading between the radiator and the circuit board.

* * * * *